US005150844A

United States Patent [19]

McKie

[11] Patent Number: 5,150,844

[45] Date of Patent: Sep. 29, 1992

[54] APPARATUS FOR SIZE REDUCTION OF HEAVY SOLID WASTE MATERIALS

[75] Inventor: R. Thomas McKie, Boise, Id.

[73] Assignee: Shanley and Baker, Washington, D.C.

[21] Appl. No.: 300,349

[22] Filed: Jan. 23, 1989

Related U.S. Application Data

[63] Continuation-in-part of Ser. No. 927,313, Nov. 4, 1986, abandoned.

[51] Int. Cl.[5] ..... B02C 12/284

[52] U.S. Cl. ..... 241/73; 241/86; 241/88.1; 241/191; 241/242

[58] Field of Search ..... 241/73, 86, 86.1, 88, 241/88.1, 88.2, 89.1, 89.3, 95, 152 A, 154, 155, 160, 191, 242, 32, 239

[56] References Cited

U.S. PATENT DOCUMENTS

| | | | |
|---|---|---|---|
| 247,749 | 10/1881 | Dawson | 241/191 |
| 646,249 | 3/1900 | Williams | 241/239 X |
| 1,494,302 | 5/1924 | Borton | 241/239 X |
| 1,606,035 | 11/1926 | Mitts | 241/32 |
| 2,858,943 | 2/1952 | Kessler | 241/191 |
| 3,426,674 | 2/1969 | Testolin | 241/191 X |
| 4,009,836 | 3/1977 | Strom et al. | 241/73 |

FOREIGN PATENT DOCUMENTS

| | | | |
|---|---|---|---|
| 746880 | 11/1966 | Canada | 241/65 |
| 1159511 | 6/1985 | U.S.S.R. | 241/88.1 |

*Primary Examiner*—Joseph M. Gorski

[57] ABSTRACT

Multiple size-reducing actions of heavy solid waste are carried out during each unidirectional rotation of a ballast-weighted drum rotor means having impact-cutter bar means projecting in fixed position about its drum surface. Feedstock contacts the rotating rotor means and is propelled against an anvil surface. Frangible materials are split and/or otherwise fragmented during such initial stage. Continued rotation cuts or crushes larger feedstock product with maximum dimensional aspects determined in part by the radial projection of the impact-cutter bar means as the latter move into a zone defined by a grate partially circumscribing the rotor means. Intermediate product in the space between the rotor drum and the grate passes through apertures in the grate or is driven into and sheared at such apertures which determines maximum cross-sectional dimensions of size-reduced product. The configuration of such grate apertures facilitates shearing of intermediate product. Clearances between rotor parts and the anvil and/or grate surfaces are adjustable; and, the anvil and/or grate are releasable under stress to avoid damage from work product which cannot be cut or crushed. Accumulation of fibrous materials on the rotor means is minimized during passage over the grate and any build-up is eliminated.

15 Claims, 5 Drawing Sheets

APPARATUS FOR SIZE REDUCTION OF HEAVY SOLID WASTE MATERIALS

This application is a continuation-in-part of copending U. S. application Ser. No. 06/927,313, filed Nov. 4, 1986, and now abandoned, entitled "Pulverizer Apparatus for Comminuting Soil-Contaminated Tree Stumps and the Like".

This invention relates to apparatus providing a plurality of size-reducing actions, including impact fragmentation, crushing, cutting and shearing during each revolution of a uni-directional rotation rotor means and is concerned with method and means for heavy-duty, high-inertia, high-efficiency, size-reduction of heavy solid waste materials including materials having significant fibrous content.

Prior size reduction mills have not been completely satisfactory in meeting current needs for economic handling of heavy, tough materials which can include substantial quantities of fiber, either inherent in the material (such as in wood) or as a component of the waste, such as man-made fibers or metal wire belting in vehicular tires. However, the present teachings provide efficient size reduction of such heavy solid waste materials as well as the capability of exercising control over maximum particle size of the end product thereof. And, also, for size reduction of mixtures of materials such as urban solid waste for purposes of compaction or shipment.

High torque is provided for sequential and/or partially simultaneous fragmenting, crushing, cutting and shearing actions during each revolution of a specially weighted rotor means within a high strength working chamber presenting a plurality of working surfaces. The apparatus is capable of exercising control over maximum dimensions of end product while working on a variety of materials including materials with fibrous constituents or components; for example, tree stumps to produce a wood chip product suitable for ground mulch or (after cleaning to remove contaminating rock and soil) for pulping or fuel; or fiber reinforced vehicular tires. Also, urban solid waste which includes man-made fiber clothing which has impaired effective size reduction in prior art mills can be effectively and efficiently handled by the present invention.

The present teachings provide equipment safety features which enable close clearances for cutting elements such that repeat tumbling of feedstock in the machine is substantially completely eliminated and energy efficiency is enhanced. Also, adjustments are available to permit choice of a maximum dimension of finished product without compromising overall strength requirements of the apparatus for handling heavy solid wastes.

Figure 1:
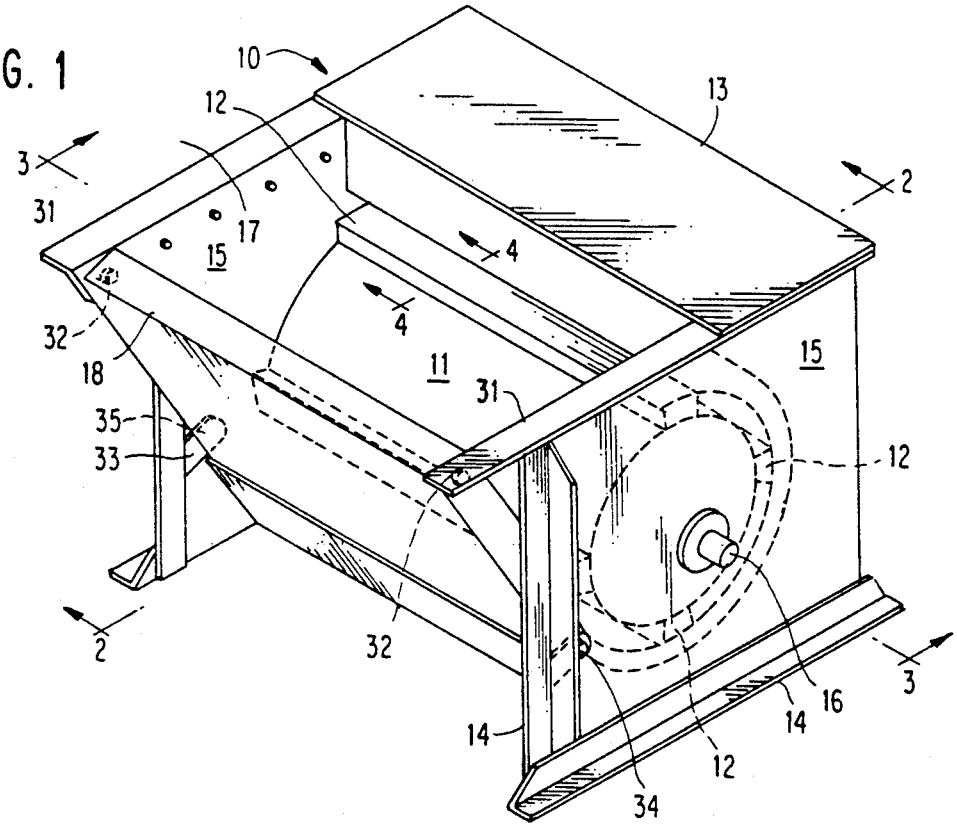
Figure 2:
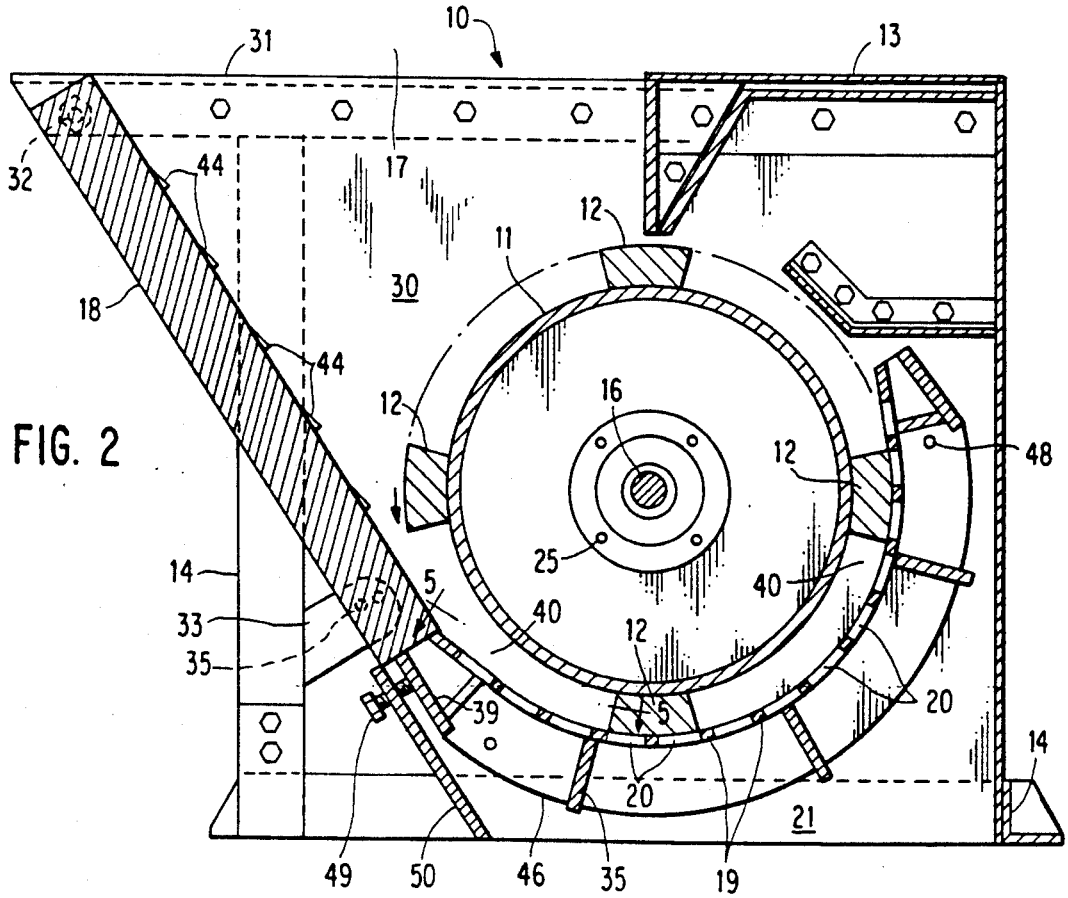
Figure 5:
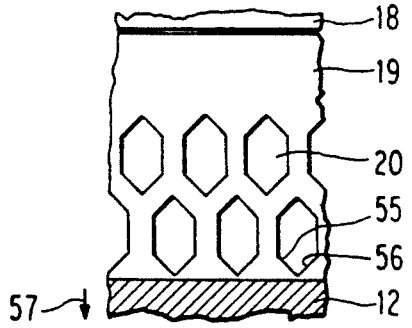
Figure 3:
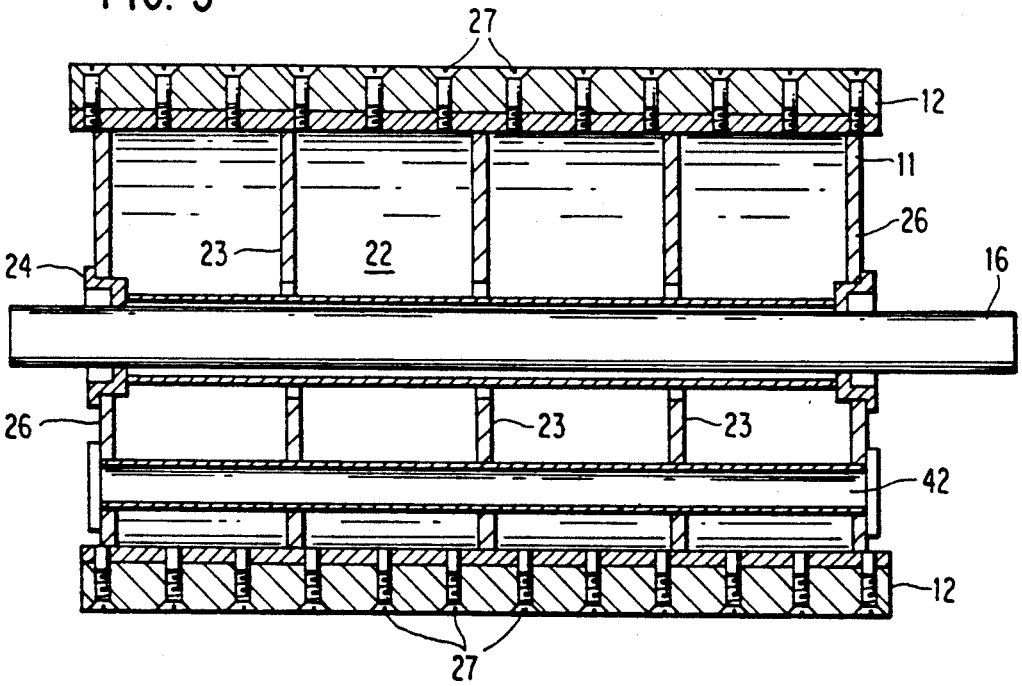
Figure 4:
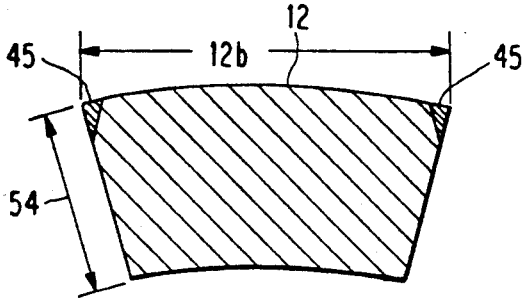
Figure 6:
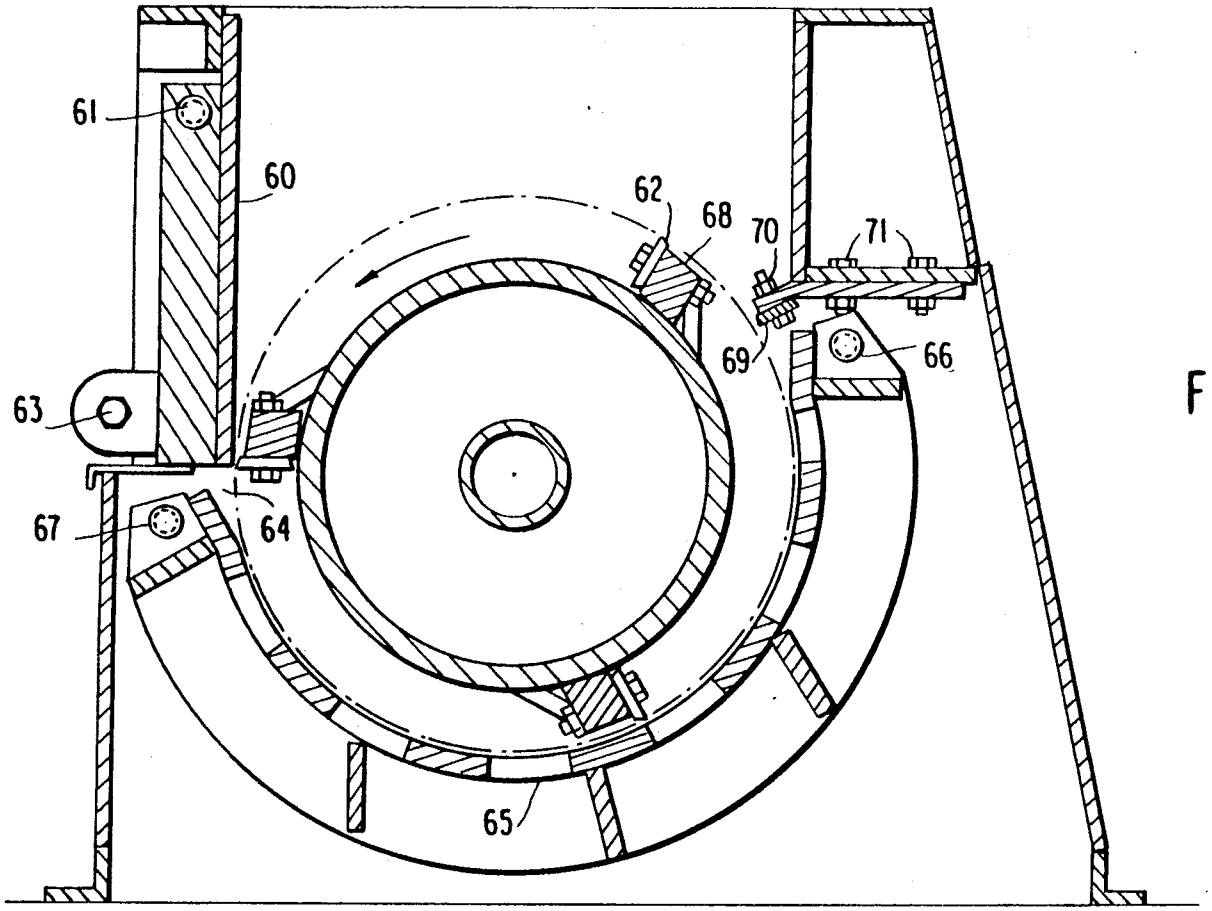
Figure 7:
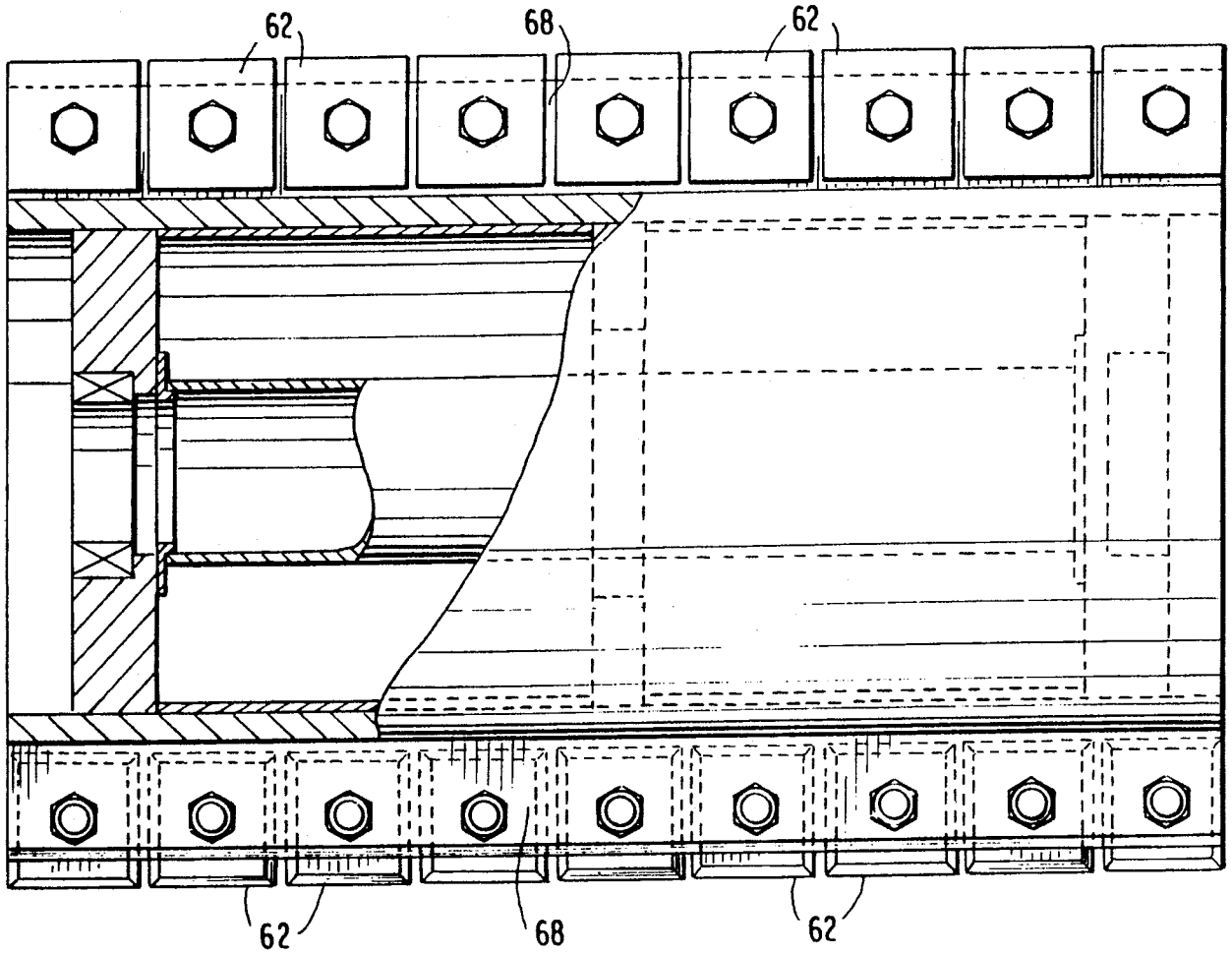
Figure 8:
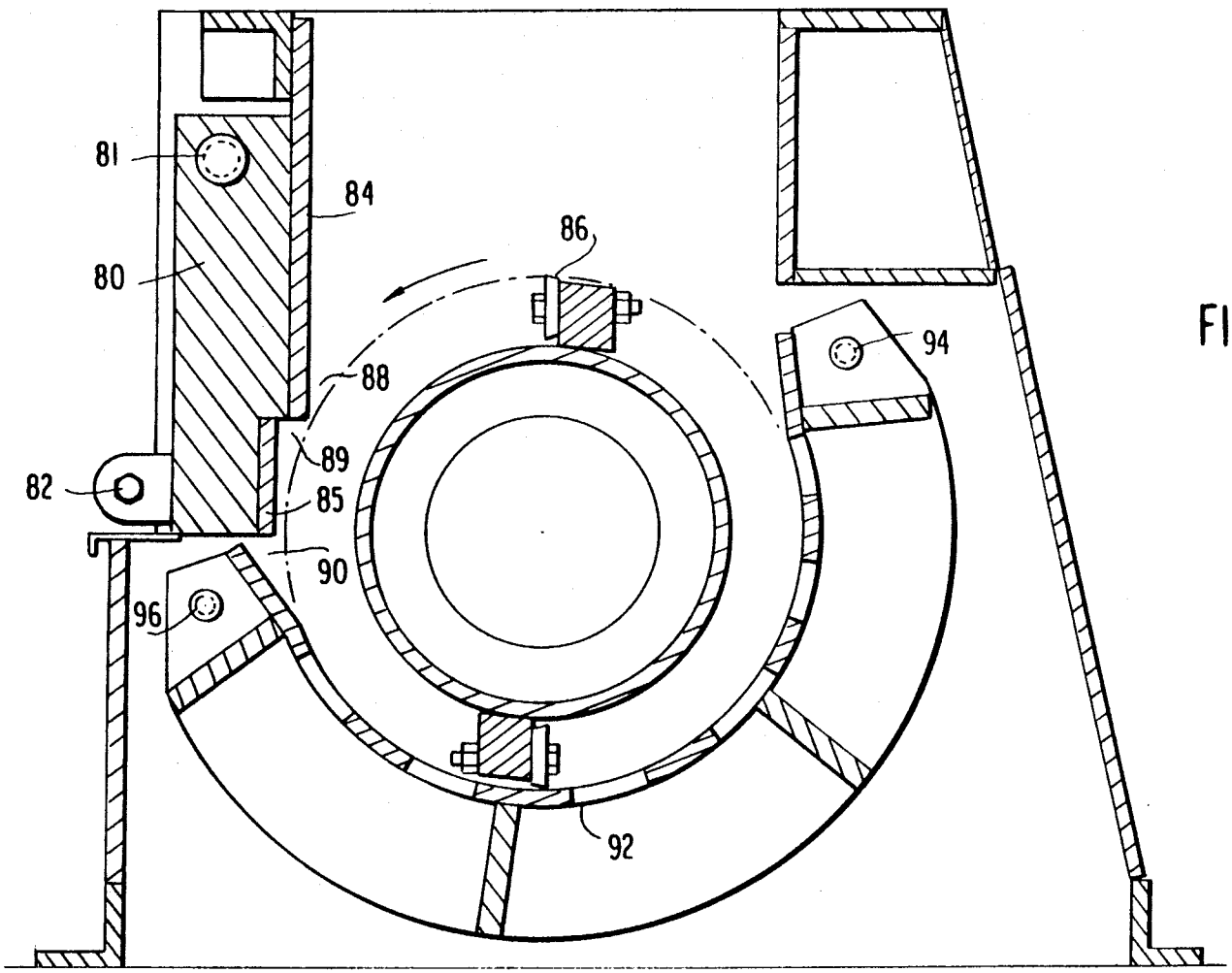

The above and additional contributions and advantages of the invention are considered in more detail in relation to the accompanying drawings, in which:

FIG. 1 is a perspective view of one embodiment of the present invention,

FIG. 2 is a cross-sectional view taken along the line 2—2 of FIG. 1, FIG. 3 is a cross-sectional view of structural features of a preferred rotor of the invention taken along line 3—3 of FIG. 1, FIG. 4 is a cross-sectional end view of an impact cutting bar taken along line 4—4 of FIG. 1, FIG. 5 is a plan view of a portion of a grate of the invention viewed along line 5—5 of FIG. 2, FIG. 6 is a cross-sectional partial view of another embodiment of the invention, FIG. 7 is a detailed view of an impact-cutting bar and rotor arrangement of the embodiment of FIG. 6, with portions cut away, and FIG. 8 is a cross-sectional partial view of another embodiment of the invention.

In the embodiment of FIGS. 1 and 2, size-reducing apparatus 10 provides for mounting rotor means which includes a cylindrical rotor drum 11 with impact-cutter bars 12 in fixed position on such drum surface.

Housing 13 includes frame supports 14 and end panels 15 are provided with additional support frame members (not shown) for mounting conventional bearing blocks for rotation of the rotor means about axial shaft 16. Housing 13 is constructed from heavy duty materials to withstand the forces required for crushing, cutting, shearing and/or impact fragmenting of heavy and tough feedstock materials within the working chamber which is supported by or defined in part by such housing means.

A feedstock inlet 17 is defined by housing 13 and directs material for fragmenting impact on the rotor drum 11 and impact-cutter bars 12. Such incoming feedstock is also fragmented by being propelled by rotor drum 11 and bars 12 against the impact surface of anvil 18.

An initial reduction in size of incoming feedstock takes place upon impact against the partially enclosed rotating means including the radially projecting impact-cutter bar means which also propel the feedstock toward the anvil surface. The impact on the rotor means and against the anvil surface pulverizes frangible materials and partially splits certain materials (such as wood along its grain).

Then, as an impact-cutter bar strikes the work product within the space defined between the anvil surface and the rotor means (at a location where the anvil surface is tangential with, or approaches the circumferential periphery of, such rotating bar 12) such feedstock is crushed and/or cut with a maximum cut dimension (for non-pulverized material) being substantially determined by the radial dimension along such impact-cutter bars 12 from the surface of rotor drum 11.

The resulting intermediate product is received into the space between the rotor drum surface and grate 19 which circumscribes from about 90° to about 225° of such rotor means in the direction of its rotation beyond anvil 18. Apertures 20 in the grate in combination with a cutting edge on each bar 12 provide a shearing action with maximum cross-sectional dimensions for cuts of intermediate product being determined by such apertures in the grate.

The grate apertures are oriented and shaped such that the intermediate product, under influence of high centrifugal forces due to rotation of the rotor means, is forced into apertures until momentarily restrained and, then, such product is sheared by the rapidly moving impact-cutter bars. The sheared product is reduced sufficiently to pass through grate apertures for discharge as finished product through the bottom discharge outlet 21 defined by the housing means.

A combination of impact pulverizing and splitting, crushing, cutting and shearing actions enables handling feedstock having a plurality of materials of different character including fibrous materials. These actions take place during each revolution of the solely unidirectional rotation of the rotor means. Feed rate is controlled so that one rotational pass of solid waste material is sufficient under normal conditions.

In a preferred embodiment of the invention, an elongated anvil is hingedly mounted at one longitudinal end with the anvil work surface at its remaining end selectively positioned adjacent to the rotor means periphery. The arrangement is such that an oversize piece of material which cannot be cut or crushed, caught in such confined space between the rotor and anvil surface, causes release of that end of the anvil which has been selectively positioned. For example, an anvil securing pin is sheared and the anvil pivots away from the rotor permitting any such non-crushable or non-cuttable tramp material to drop from the working chamber and avoid damage to the apparatus.

The anvil position can also be adjusted about its support on the housing frame to allow selection of clearances between the anvil work surface and the peripheral circumference of the rotating cutter bar(s); such adjustment permits minor leeway in the maximum cut dimension of the intermediate product which is otherwise determined by radial spacing of the cutting edge of bar 12 from rotor drum surface 11.

As taught herein, the rotor means is preferably initially constructed with a substantially hollow cylindrical space 22 (FIG. 3) with internal strengthening ribs 23; the drum and ribs being formed, e.g., from structural steel. The drum is fitted to axial shaft 16 which is keyed by means of fittings 24 fixed by bolts 25 (FIG. 2) in drum heads 26. The shaft 16 may be made of a continuous cylindrical member extending through the drum, as shown, or comprised of two stub shafts. Either arrangement is keyed to fittings 24.

One or more extended-length impact-cutter bars 12 is fixed to the external peripheral surface of drum 11. A series of countersunk bolts 27, as shown in FIG. 3, can be used to secure an impact-cutter bar 12. Such bars have an inner and outer surface which can be arcuate as shown in cross section in FIG. 4; other configurations are shown later herein.

The hollow interior 22 of the drum is filled with a ballast material, for example, lead, after mounting of impact-cutter bar means. The ballast may be permanently flowable material, such as lead shot; but, preferably in accordance with present teachings, the ballast material is melted, poured into the drum cavity, and solidified in place. An intermittent pouring and solidification method is preferred in order to maximize ballast and increase efficiency. The ballast insures high-energy torque sufficient to drive peripheral cutting edges through hard materials including tough fibers, such as steel wire or fiber reinforcing for vehicular tires. An additional benefit of the ballast is that it greatly reduces the sound level of the size-reduction action and helps smooth out power requirements. Using lead as a ballast material, weights in excess of 700 lbs. per cubic foot of rotor drum volume are achieved so as to provide rotor weights as set forth later herein which enable single-pass size reductions of the tough fibrous materials set forth.

The rotor means, the surface of the anvil, and adjacent portions of the housing, such as sidewall 15 portions, help to define a zone 30 for initial fragmentation of portions of the inlet feedstock by impact pulverizing and/or splitting action which are facilitated by the high energy torque of the ballast filled rotor. Such fragmentation is followed by a cutting and/or crushing action between the peripheral circumference of the cutter bars and/or rotor drum and the anvil as such surfaces define and interact in the confined space between the anvil surface and such peripheral circumferential paths of the rotor means.

Anvil 18 is pivotally mounted at an upper frame portion support beam 31 by means of hinge pin 32 (FIGS. 1, 2). The lower portion of the anvil 18 is controllably positioned relative to support column 14 prior to use. As mentioned, provision is also made for release thereof under strain when oversize pieces of material, which cannot be cut or crushed, are caught between such anvil and rotor means. In one embodiment, the lower portion of anvil 18 is secured to a frame support member 33 by means of a shear pin 34 which can be fitted into a selected one of a number of pin apertures (such as 35) extending along an arcuate path on each support member 33. Such selection establishes the desired clearance between a peripheral circumference of rotation of cutter bar 12 and its closest point of approach to the surface of the anvil 18 (which can be at a point of tangential relationship). In a representative embodiment, the clearance leading into zone 40 may be adjusted to approximately $\frac{1}{4}$, $\frac{1}{2}$ or $\frac{3}{4}$ inch for a wood stump material. The adjustable anvil clearance helps to achieve desired flow-through of feedstock in tons/hour and is chosen based on the character of the material to be reduced in size.

The swing-away release of anvil 18 about pivot axis 32 clears certain oversized tramp items from the working chamber without damage to the rotor or other parts of the apparatus. Large metal structures are not generally part of tree stump or vehicular tire feedstock; however, imbedded heavy metal pieces or other such oversize materials which may occur in certain feedstock can be eliminated without damage to parts of the apparatus.

Cleats 44, which can be wedge-shaped, can be included on the anvil surface to help provide a splitting action during impact of certain feedstock such as wood materials. A working surface for anvil 18 can be changed or replaced upon wear, as can other wear surfaces as shown and discussed later.

During down time, the swing-away feature for anvil 18 enables access to internal wear parts for replacement. For example, the cutting tools 45 mounted along the edges of bar 12 (FIG. 4); in one embodiment the entire bar can be reversed to maintain a shape cutting edge on the leading side of the bar. Replacement maintenance can generally be performed through the feed inlet access or the access provided by the swinging anvil; so that internal wear surfaces, which are generally protected with abrasion-resistant plate, such as tungsten carbide, can be replaced without dismantling the equipment.

The cutter-bar means protrude from the rotor surface with a major component in the radial direction. The elongated cutter bars of FIGS. 1–3, can extend in a straight line along the drum surface with no advantage being observed through use of spiral or other curvilinear orientation on such surface.

The grate 19 preferably extends over at least about a 180° arc with respect to the rotor; however, an operable range of arc for the grate can be from about 90° to about 225°.

The grate includes strengthening and stiffening means 46 (FIG. 2). Grate 19 is supported within the housing frame at least in part by a hinge pin fitted, in the embodiment of FIG. 2, within an aperture 48 near its upper end. A lower portion of the grate 19 is supported by means of adjustable bolt 49 threaded into a frame support member 50. Bolt 49 bears upon a lower grate surface 52; such threaded bolt arrangement permits adjustment of the clearance between the peripheral circumference of rotation of cutter bar 12 and grate 19; typically clearances up to about ⅛ inch are provided.

The zone bounded by the grate 19, the rotor drum surface and the projecting impact-cutter bars 12 receives intermediate product after earlier fragmenting, crushing or cutting. The function of the grate 19 is to further reduce any oversized portions of the intermediate product to acceptable maximum dimension.

In operation, the centrifugal force of the high-energy torque rotor means causes the intermediate product to be projected continuously toward the grate 19 and its apertures 20. Certain portions pass directly through such apertures. Remaining (larger) pieces are driven into and momentarily restrained within such apertures 20 where they are sheared by cutting edges of impact-cutting bars 12 and edges of apertures 20. Portions of the work product as sheared off in the apertures pass through the grate 19 as finished product.

Maximum dimensional aspects of solid portions of finished product can be determined by either, or coaction between, the dimensions of the grate apertures 20 and the radial dimension 54 (FIG. 4) of a cutter bar 12. Finished product will not be significantly greater dimensionally than the cutter bar radius 54 plus any allowed clearance with anvil 18; and, the cross-sectional dimensions will not exceed those of the apertures 20. Such dimensionally established parameters for finished product enables better, more efficient and easier control for subsequent handling through feeders or other transport systems; or, for subsequent handling by compactors.

Another feature of the invention relates to the shape and arrangement of the grate apertures 20. The dimensions and orientation of the apertures are elected so that the leading edges 55, 56 (FIG. 5) of each aperture, with respect to rotor rotation as indicated by arrow 57, define an acute angle convergance the direction of rotation of impact-cutter bar 12. Leading edges (such as 55, 56) can be periodically sharpened between wear replacements of the entire grate 19.

In a preferred embodiment, the grate defines hexagonal apertures having a pair of sides which are substantially parallel to the rotational direction of the rotor means 11; such sides can be lengthened to increase the cross section of the apertures. The acute angled, leading edge arrangement provides an efficient scissor-like shearing action on work product pieces as momentarily restrained by an aperture 20. This shearing action is particularly effective in cutting fibrous materials.

FIG. 5 shows a pattern of staggered grate apertures with such preferred rectilinear edges. The grate can be formed from about ¾ inch thick plate steel with case hardened properties and/or with tungsten carbide inserts. A cross sectional area of about four square inches per aperture, located on approximately one inch centers and aligned along staggered rows is typical for tree stump feedstock.

The working stroke of rotor means 11 is solely unidirectional. By making openings 20 symmetrical, the grate itself can be removed and reinserted so as to allow use of opposite edges before replacement of the entire grate, or sharpening of leading edges, as necessary. The cross-sectional dimensions of the apertures can be selected, as previously described, to help control maximum cross-sectional dimensions for finished product.

The elongated, rectilinearly-oriented cutter bars are rigidly attached to a rotor drum before adding the heavy ballast which provides the high torque kinetic energy for the various size-reducing actions carried out in a single rotation of the rotor means.

Frangible materials, such as dry soil or glass, are pulverized upon impact with the rotor means or anvil means. Wood or similar materials can be split along grain boundaries upon impact with anvil 18; and, remaining large-piece product is cut and then driven into contact with grate 19. The high centrifugal force exerted upon work product assists in producing the desired finished sizes by driving the work product into momentarily restrained contact within the grate apertures for shearing by rotation of a cutter bar.

The work product is not repeatedly tumbled as in hammermills. Inlet feed rates are controlled and retumbling is eliminated substantially completely to achieve the feed and production rates set forth later; although, infrequently, an extremely hard core piece may not be sufficiently reduced in size to pass through the apertures 20 during one passage.

In the embodiment of FIG. 6 anvil 60 is pivotally mounted about axis 61 and is vertically oriented in tangential relationship to the circumferential path of impact-cutter bars 62 unless broken away by shearing of shear pin 63. A relief zone 64 is provided at the entrance portion to apertured grate 65; the latter is pivotally mounted about axis 66 but is held in the position shown unless broken away by shearing of grate shear pin 67.

Impact-cutter bars 62 are mounted on the drum surface using holder-support structures 68 which are aerodynamically shaped to reduce wind resistance. Another feature of the embodiment of FIG. 6 is fiber stripper 69 which cuts fibrous streamers (such as hosiery made from man-made fibers found in urban solid waste) which can attach to impact-cutter elements 62 if not completely cut by the shearing action at the leading edges of the grate apertures. Stripper 69 cuts such streamers and is controllably located by adjustment means 70, 71 on the frame member.

As better seen in FIG. 7, the impact-cutter is divided into individual impact-cutter elements 62 in the embodiment of FIG. 6. With this feature, impact-cutter elements 62 can be replaced individually long the full length of holder support structure 68.

In the embodiment of FIG. 8, anvil 80 is mounted for pivotal movement about axis 81 upon release by shearing of shear pin 82. Anvil 80 presents separate working surfaces 84, 85. In the illustrated embodiment, work surface 85 is offset from 84 in the direction of rotation of impact-cutter bars 86. These dual impact surfaces provide dual confinement zones 88, 89 and dual cutting actions which are advantageous for certain types of solid waste. Anvil surface 84 is directed vertically into close proximity to the peripheral circumference of impact cutter bars 86; and, anvil surface 85 is substantially tangential to the radius of rotation. Relief area 90 is provided, to allow for some loosening of the work product, after the compacting action in confinement zones 88, 89, before entry along the cylindrical surface of grate 92. The latter is mounted for pivotal movement about axis 94 in the event that some material which cannot be cut or crushed causes shearing of shear pin 96.

As described above, such embodiments provide: a range of size-reduction systems with weighted rotors for maximizing torque and increasing efficiency, a cutting system capable of cutting fibrous materials, wire belting or other man-made fibers and, having replaceable wear surface(s) and a release system on the anvil and/or grate to prevent damage due to oversized items, which cannot be crushed or cut, occurring the solid waste work product.

Typical rotor sizes range from sixty (60) to twenty-four (24) inches in diameter (at the peripheral circumference of the impact-cutter bars) and from one hundred twenty (120) to thirty-six (36) inches in length; rotor and ballast weights range from fifty-five (55) tons to six (6) tons providing capacities for tree stumps, railroad ties or vehicular tires from three hundred (300) tons per hour to twenty (20) tons per hour at 600 to 1200 RPM; maximum particle dimension can be selectable between about six (6) to about four (4) inches.

Specific dimensions, values and materials have been set forth for purposes of describing the invention and the manner and process of making and using the same; however, teachings provided by the above disclosure would enable one skilled in the art to vary such dimensions, values or materials while still relying on the invention; therefore, for purposes of determining the scope of the present invention reference should be made to the appended claims.

I claim:

1. Rotary-type apparatus for carrying out a plurality of size reduction actions, including impact fragmentation, crushing, cutting and shearing of heavy feedstock, comprising (A) housing means defining
a feedstock inlet,
an outlet for finished product, and
a working chamber, (B) unidirectional rotation rotor means,
such rotor means being mounted for solely unidirectional rotation within such working chamber for providing such plurality of size reduction actions on feedstock during each such unidirectional rotation of such rotor means,
such rotor means including
a drum presenting an external surface symmetrically disposed with relation to a centrally-located axis of rotation for such rotor means, and
impact-cutter bar means in a fixed positional relationship projecting from such drum external surface so as to maintain a fixed uniform diameter cylindrical-configuration peripheral path for such impact-cutter bar means during such rotation of such rotor means, and (C) a plurality of work surface within such working chamber, including:
(i) an extended-area substantially-planar work surface presented by anvil means which can be selectively positioned in angled relationship with the peripheral path of rotation of such impact-cutter bear means to define a confined space between such anvil means work surface, such drum exterior surface and such peripheral path of such fixed impact-cutter bar means during rotation of such rotor means,
such anvil means work surface and rotor means coating to provide
size reduction by impact fragmentation of frangible feedstock impelled by such rotor means against such anvil means work surface, and
size reduction by a cutting and/or crushing action of other feedstock to form intermediate work product by coaction in such confined space between such anvil means work surface and such drum external surface and/or the impact-cutter bar means of the rotor means as the peripheral circumferential path of rotation defined by rotation of such drum and impact-cutter bar means approaches and passes in contiguous relationship to such anvil means work surface; and
(ii) an apertured grate surface presented by grate means for providing additional size-reduction by coaction between such rotor means and grate means,
such grate means circumscribing a major portion of such peripheral circumferential path of rotation of such impact-cutter bar means,
such portion circumscribed by such grate means being located subsequent to such anvil means in such direction of rotation of such impact-cutter bar means in passing contiguous to such anvil means work surface so as to define a zone which is between at least a portion of the drum surface and such grate means for carrying out such additional size reduction of intermediate product,
such grate means working surface confronting the interior of such working chamber with spacing between such circumscribing portion of the grate means working surface and such peripheral path of the impact-cutter bar means being controllably fixed during size reduction operation of the rotary-type apparatus,
such grate means presenting apertures which extend through such grate means from such working chamber to such outlet for finished product and which are positioned such that rotation of such rotor means drives intermediate product into such grate apertures,
such apertures having a cross-sectional configuration facilitating a shearing action along such peripheral circumferential path of rotation of such impact-cutter bar means,
such shearing action taking place on intermediate product being held by such grate apertures and protruding into such working chamber by passage of such impact-cutter bar means contiguous to such grate means working surface with such shearing action causing release of sheared product enabling passage through such apertures toward such outlet for discharge of finished product.

2. The apparatus of claim 1 in which
such rotor drum has a substantially cylindrical configuration external surface, and in which
incoming feedstock impacting with such rotor means initiates size reduction upon frangible portions of such feedstock.

3. The apparatus of claim 1 in which
such impact-cutter bar means in fixed positional relationship projecting from such drum external surface comprise
a plurality of fixed position impact-cutter bars disposed about such drum external surface in symmetrical relationship to such axis of rotation.

4. The apparatus of claim 3 in which
such impact-cutter bars include
a replaceable cutting tool located contiguous to the periphery of such impact-cutter bars, at the leading edge thereof in such direction of rotation of such bars, such cutting tool presenting a cutting edge defining the peripheral dimension for such path of rotation of such bar means.

5. The apparatus of claim 4 in which holders for such impact-cutter bars are aerodynamically shaped in radial cross section in approaching trailing edges thereof so as to reduce drag and improve efficiency during size reduction rotation of such rotor means.

6. The apparatus of claim 3 in which such impact-cutter bars project from such drum surface to provide a uniform diameter cylindrical-configuration circumferential path of rotation.

7. The apparatus of claim 6 in which such circumferential path of rotation passes in contiguous relationship with such anvil means work surface and, further including means for adjusting the angled relationship of such anvil means work surface and controlling spacing between such anvil means work surface and such circumferential path of rotation where such path passes in contiguous relationship with such anvil means work surface.

8. The apparatus of claim 3, further including means for preliminarily controlling spacing between such peripheral path of rotation of such impact-cutter bars and the working surface of such grate means confronting the interior of such working chamber, and release means for opening such spacing between the grate means and such peripheral path of rotation of such impact-cutter bars for oversized non-crushable or non-cuttable work product while otherwise maintaining such fixed controlled spacing during normal size-reduction usage of the rotary-type apparatus.

9. The apparatus of claim 3 in which location of such work surface portion of the anvil means contiguous to such rotor means peripheral path is adjustable by selective positioning of shear pin means coacting with such housing means to anchor such anvil means during normal size reduction usage, such shear pin means permitting movement of one end of the anvil means away from such peripheral path of such rotor means so as to dislodge oversized contaminant which cannot be cut or crushed between such rotor means and such anvil working surface.

10. The apparatus of claim 3 in which such grate means extends over an arc in the range of about 90° to about 225° of the size-reducing rotation of such rotor means.

11. The apparatus of claim 10 which such rotor means rotates at a rate to provide a peripheral speed for such impact-cutter bar means in the range of about 100 to about 150 fps.

12. The apparatus of claim 1 in which such rotor drum defines an internal space symmetrically disposed in relation to such axis of rotation, and such internal space is filled with ballast to increase inertia of such rotor means during its rotation.

13. The apparatus of claim 12 in which molten metal of high specific gravity is added to and solidified in stages within such internal space so as to maximize the weight of, and uniformly distribute, such ballast.

14. The apparatus of claim 1 in which an aperture as defined by such grate means presents shearing edges in acute angled relationship which converge in the direction of rotation of such impact-cutter bar means so as to facilitate shearing of fibrous materials by such rotation.

15. The apparatus of claim 14 in which apertures as defined by such grate means have an elongated hexagonal configuration confronting such working chamber with such acute angled edges being located at the longitudinal end of such configuration which is oriented in the direction of rotation of such rotor means.

* * * * *